US006976444B1

(12) United States Patent
Seiford, Sr.

(10) Patent No.: US 6,976,444 B1
(45) Date of Patent: Dec. 20, 2005

(54) MARINE VESSEL PROPULSION AND TUBULAR RUDDER SYSTEM

(76) Inventor: Donald S. Seiford, Sr., 14312 Vista Del Lago Blvd., Winter Garden, FL (US) 34787

( * ) Notice: Subject to any disclaimer, the term of this patent is extended or adjusted under 35 U.S.C. 154(b) by 0 days.

(21) Appl. No.: 10/992,837

(22) Filed: Nov. 22, 2004

(51) Int. Cl.[7] ..... B63H 25/06

(52) U.S. Cl. ..... 114/166; 114/163; 440/67

(58) Field of Search ..... 114/144 R, 163, 114/166; 440/66, 67

(56) References Cited

U.S. PATENT DOCUMENTS

| | | | | | |
|---|---|---|---|---|---|
| 2,011,618 | A | * | 8/1935 | Dawson | 114/163 |
| 2,201,859 | A | * | 5/1940 | Edwards | 114/163 |
| 2,803,211 | A | * | 8/1957 | Erlbacher | 114/166 |
| 3,115,112 | A | * | 12/1963 | Erlbacher | 114/166 |
| 3,457,891 | A | * | 7/1969 | Clark et al. | 114/163 |
| 3,605,672 | A | * | 9/1971 | Strumbos | 114/166 |
| 4,046,097 | A | * | 9/1977 | Hornung | 440/67 |
| 4,773,347 | A | * | 9/1988 | Winterbottom | 114/166 |

* cited by examiner

*Primary Examiner*—Lars A. Olson
(74) *Attorney, Agent, or Firm*—Ronald E. Greigg

(57) ABSTRACT

A water craft propulsion and steering system is disclosed in which a pair of tubular steering rudders are mounted one on the front end and aft end, respectively, of a propeller shroud tube. Power means is provided for turning both steering rudders in the same direction for increased steering thrust.

21 Claims, 7 Drawing Sheets

MARINE VESSEL PROPULSION AND TUBULAR RUDDER SYSTEM

BACKGROUND OF THE INVENTION

1. Field of the Invention

This invention relates to an improved marine vessel propulsion and steering system, and more particularly to such a system including a shrouded propeller and tubular forward steering and backing rudders mounted on the aft and forward ends, respectively, of the propeller shroud.

2. Description of the Prior Art

The use of the shrouded propellers on ships and another water craft, including tug boats, barge pushers, and the like as well as pleasure boats (hereinafter, sometimes vessels) to enhance propulsion efficiency, reduce vibration and turbulence in the vessel wake, and to protect the propeller is well known. It is also well known to employ a steering rudder in the form of a short tube mounted for pivotal movement about a vertical axis in position to deflect the propeller race to steer the vessel.

U.S. Pat. No. 2,803,211 discloses a tubular rudder system for a vessel including a forward steering tubular rudder positioned in the propeller race aft of the propeller and a separate backing tubular rudder positioned forward of the propeller and surrounding the propeller shaft. The rudders, which may be substantially identical, are mounted on separate, individually controlled rudder posts for pivotal movement about vertical axes each contained in the vertical plane of the propeller shaft. The propeller is not shrouded, and the rudder diameters are smaller than the diameter of the propeller. There is no suggestion of utilizing both rudders simultaneously for steering both in the forward and backing directions of the propeller. Also, the small diameter and airfoil design of the rudder may restrict water flow and therefore reduce propulsion. The airfoil structure is also expensive to manufacture.

U.S. Pat. No. 3,082,728 discloses a Kort-type rudder using a single tubular member acting both as a rudder and a propeller shroud, with the rudder post being positioned directly above the propeller, and the inside diameter of the rudder tube being great enough to permit the rudder to turn about the rudder post without striking the propeller. The rudder post is mounted to permit tilting of the rudder to assist in banking the vessel.

U.S. Pat. No. 3,115,112 discloses a tubular rudder which may be mounted rearward of the propeller or extending over the propeller as in a Kort design.

While the known tubular rudders, including Kort type rudders in which the rudder tube extends around the propeller, have shown improvement over conventional blade rudders, especially in reducing turbulence in the vessel's wake and the reduction of vibration, these known rudder systems have not proven entirely satisfactory, especially for vessels such as tugs, barge pushers and the like normally having relatively high power and requiring high maneuverability, as well as smaller vessels which frequently operate in crowded waters where maneuverability and reduced turbulence is highly desirable.

It is therefore an object of the present invention to provide an improved propulsion and steering systems for vessels including a shrouded propeller and two tubular rudders disposed one aft and one forward of the propeller.

Another object is to provide such a system which provides increased maneuverability for the vessel.

Another object is to provide such a system is which the two tubular rudders are operable simultaneously to provide greater steering capacity.

A further object is to provide such a system in which the two tubular rudders are mounted on the propeller shroud tube for pivotal movement to steer the vessel.

A further object is to provide such a system in which the tubular rudders are each mounted at its top and bottom to the propeller shroud for increased strength and stability.

Another object is to provide such a system which is both inexpensive to manufacture and easy to maintain.

SUMMARY OF THE INVENTION

In the attainment of the foregoing and other objects of the invention, an important feature resides in providing a cylindrical shroud tube rigidly mounted on and spaced below the vessel hull and surrounding the vessel's propeller. The shroud tube has its longitudinal axis coincident with the propeller shaft of the vessel and preferably extends approximately an equal distance forward and aft of the vertical plane of the propeller. The opposed sides of the shroud tube, at each end thereof are relieved, or cut back along lines defined by the intersection of two vertical planes extending at a desired angle, preferably about 45° to the vertical plane containing the propeller shaft axis, with the line of intersection containing the shaft axis. Thus, the top and bottom surface portions of the shroud tube at each end therefor terminate in a generally pointed end.

A tubular forward steering rudder, i.e., a rudder for steering the vessel during forward movement, has its forward end mounted on the two rearwardly directed pointed end portions of the shroud tube, and a tubular backing rudders has its aft end mounted on the two forwardly directed pointed end portions of the shroud tube, each for pivotal movement about a vertical axis lying in the vertical plane containing the propeller shaft and shroud tube axes.

The tubular rudders are oblong in vertical cross-section, for example, being generally flat on their top and bottom surfaces, and their opposed side surfaces being substantially semi-circular, with the semi-circular side portions having an inner diameter slightly greater than the outer diameter of the shroud tube so that the rudder tubes can be telescoped over the pointed end portion of the shroud tube for pivotal mounting. Axially extending mounting tabs may be provided on the rudder tubes and/or the pointed end portions of the shroud tubes.

Drive means is provided for rotating the rudder tubes about their respective vertical mounting axes, preferably simultaneously, in the same direction so that water is drawn into one tube by the propeller and by movement of the vessel through the water, and expelled from the other tube. Thus, if the forward end of the backing rudder tube is displaced to port, the rearward rudder tube will have its aft end displaced to starboard, with the effect that the steering force of the two rudders is additive and the vessel can turn in an extraordinarily tight radius. For example, one or more submersible fluid actuators or hydraulic cylinders may have one end mounted on the shroud tube and the other connected to one of the rudder tubes, with hydraulic pressure to the cylinder being controlled from a control valve in at the vessel control bridge. These cylinders could be mounted into a protective sleeve (not shown) to protect them from damage from underwater obstacles, such as logs. For simultaneous movement of both rudder tubes, separate hydraulic cylinders may be connected to each rudder tube, or a linkage may be provided between the two rudder tubes so that movement of one results in movement of the other. One of the rudders tubes may also be rotated by a rudder post extending into the vessel, and again a second rudder post may be employed to drive the second rudder tube or alternatively the two rudder tubes may be connected by an articulated linkage for simultaneous movement.

The backing rudder tube preferably is constructed from two half-sections bolted or otherwise joined along a flange for separation to permit installation and/or removal, for example for propeller repair or shaft removal. Also, the backing rudder may have notches in its opposed sides at its forward end to permit greater angular movement without engaging the shaft.

BRIEF DESCRIPTION OF THE DRAWINGS

Other features and advantages of the invention will become apparent from the detailed description contained herein below, taken in conjunction with the drawings, in which.

DESCRIPTION OF THE PREFERRED EMBODIMENTS

Figure 1:
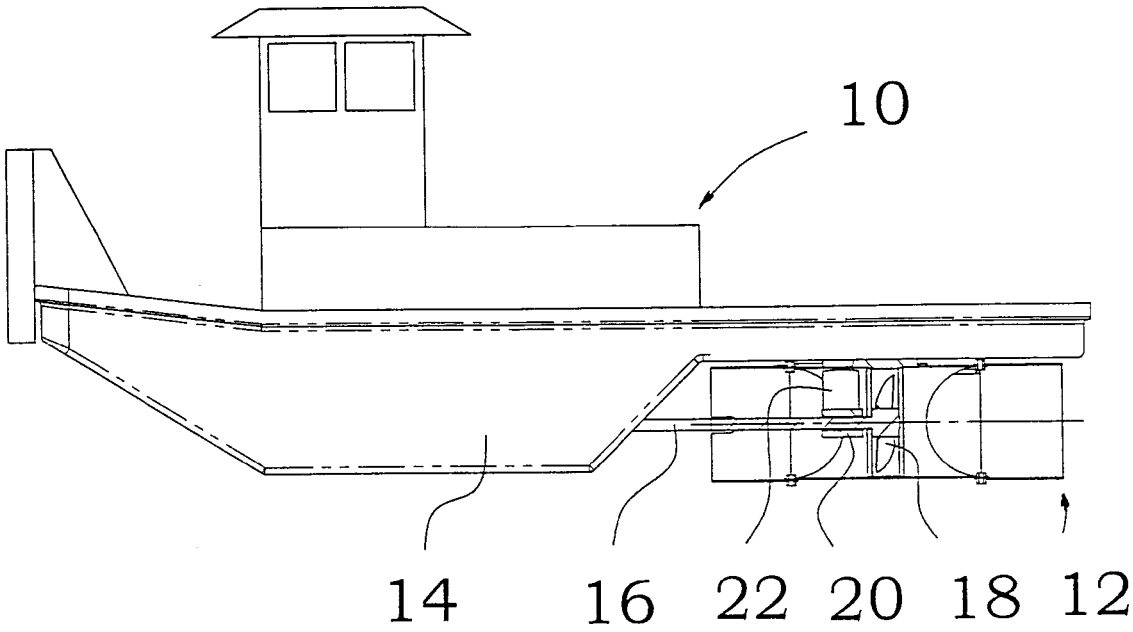
FIG. 1 is an elevation view, partially in section, of a vessel embodying the propulsion and steering system according to the invention.
Figure 2:
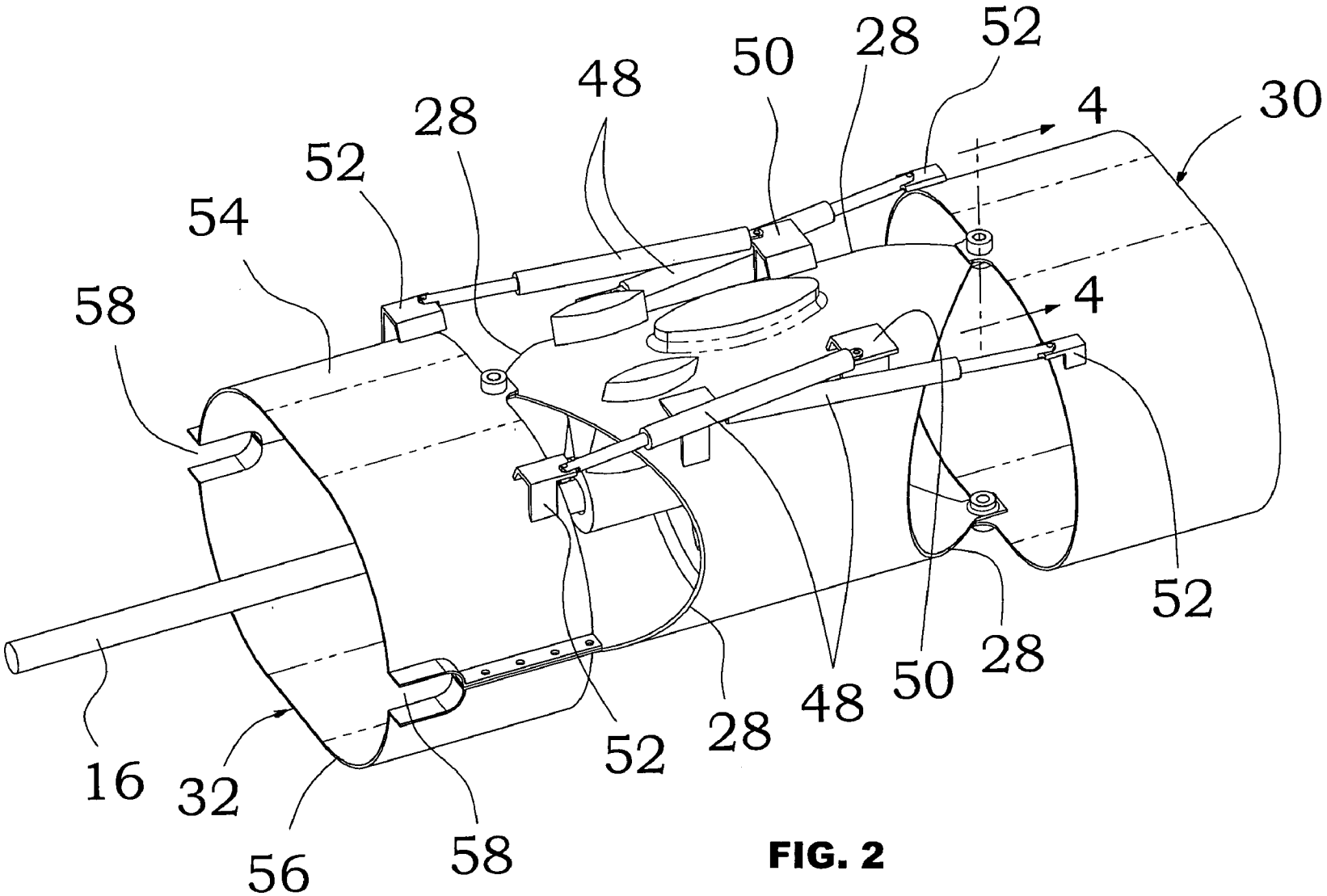
FIG. 2 is an isometric view of the system shown in FIG. 1.
Figure 3:
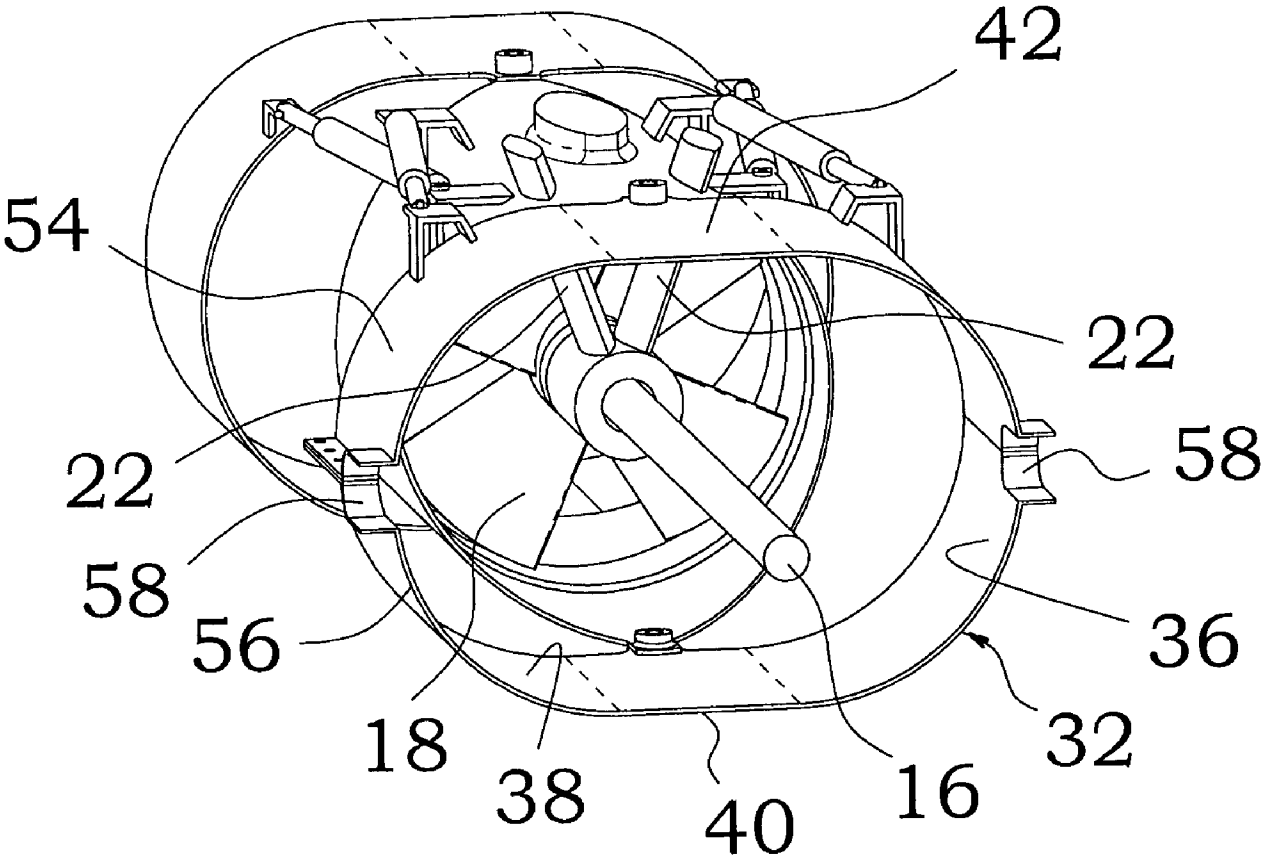
FIG. 3 is an isometric elevation view, looking aft, of the system shown in FIG. 2.

Referring now to the drawings in detail, a vessel 10, for example a barge pushing vessel, is schematically illustrated in FIG. 1 as including a propulsion and steering system of the invention, designated generally by the reference numeral 12, mounted beneath the bottom hull 14 of the vessel. The vessel includes a propeller shaft 16 driven in the conventional manner by a power source inside the hull 14, with a propeller 18 mounted on the end of shaft 16. A shaft bearing 20 supported by a pair of bearing struts 22 supports the free end of shaft just forward of the propeller. A substantially cylindrical tubular propeller shroud 24 is mounted, by a raised, reinforced mounting pad or strut 26, to a mating mounting pad (not shown) on the vessel bottom. Bearing struts 22 may also be mounted directly to the vessel bottom in a similar manner. The struts 22 and mounting pad 26 may project above the top surface of the shroud tube 24 a distance necessary to space the shroud tube at the proper distance below the vessel hull.

The shroud tube 24 may be fabricated from a length of a relatively heavy gage steel pipe of a suitable alloy to provide the necessary strength and corrosion resistance. The inside diameter of the shroud is sufficiently larger than the diameter of the propeller 18 to provide the necessary clearance, and the shroud is mounted with its longitudinal axis coincident with the axis of the shaft 16 and with its opposed ends extending approximately equal distance forward and aft of the propeller plane.

The shroud tube 24 has its laterally opposed side portions relieved, or cut-back along lines 28, at each end to provide clearance for pivotal movement of rudder tubes 30, 32 as described more fully herein below. The cut-back lines 28, preferably is defined by vertical planes each extending at a desired angle, preferably about 45°, to the horizontal axis of shaft 16 and intersecting each other at a vertical line passing through the axis of shaft 16. Thus, the cut-backs provide a axially extending generally pointed top and bottom portion at each end of the shroud tube. The cut-backs preferably do not extend to a sharp point, but rather terminate in an axially extending mounting tab 34, the purpose of which will be more fully described below.

Figure 4:
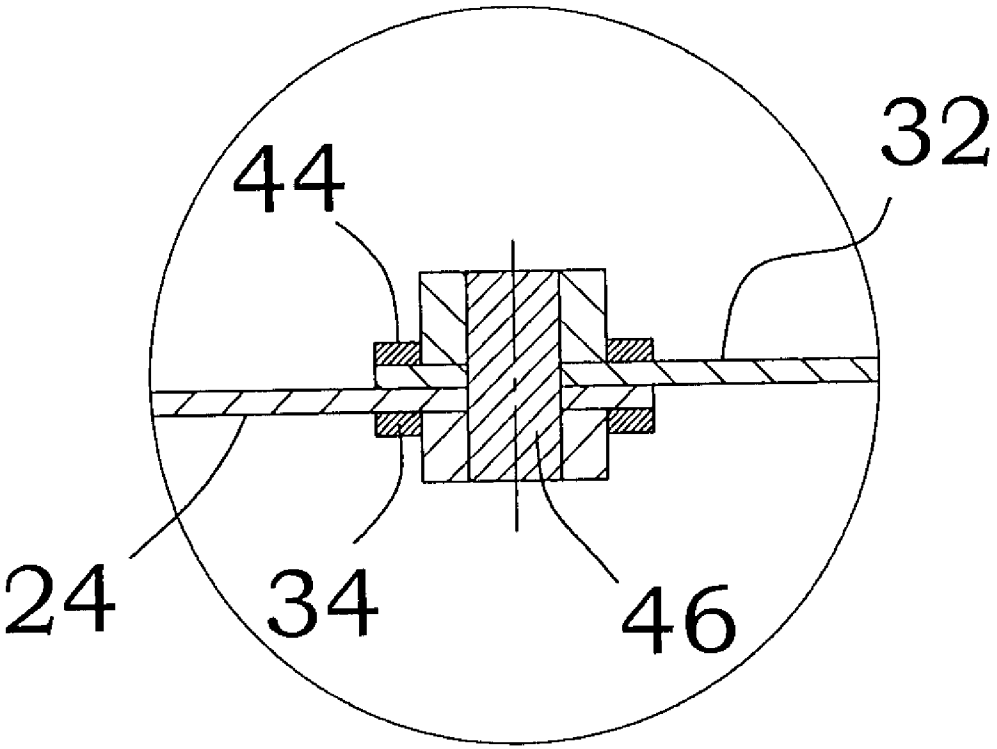
FIG. 4 is a fragmentary sectional view taken along lines 4—4 of FIG. 3.
Figure 5:
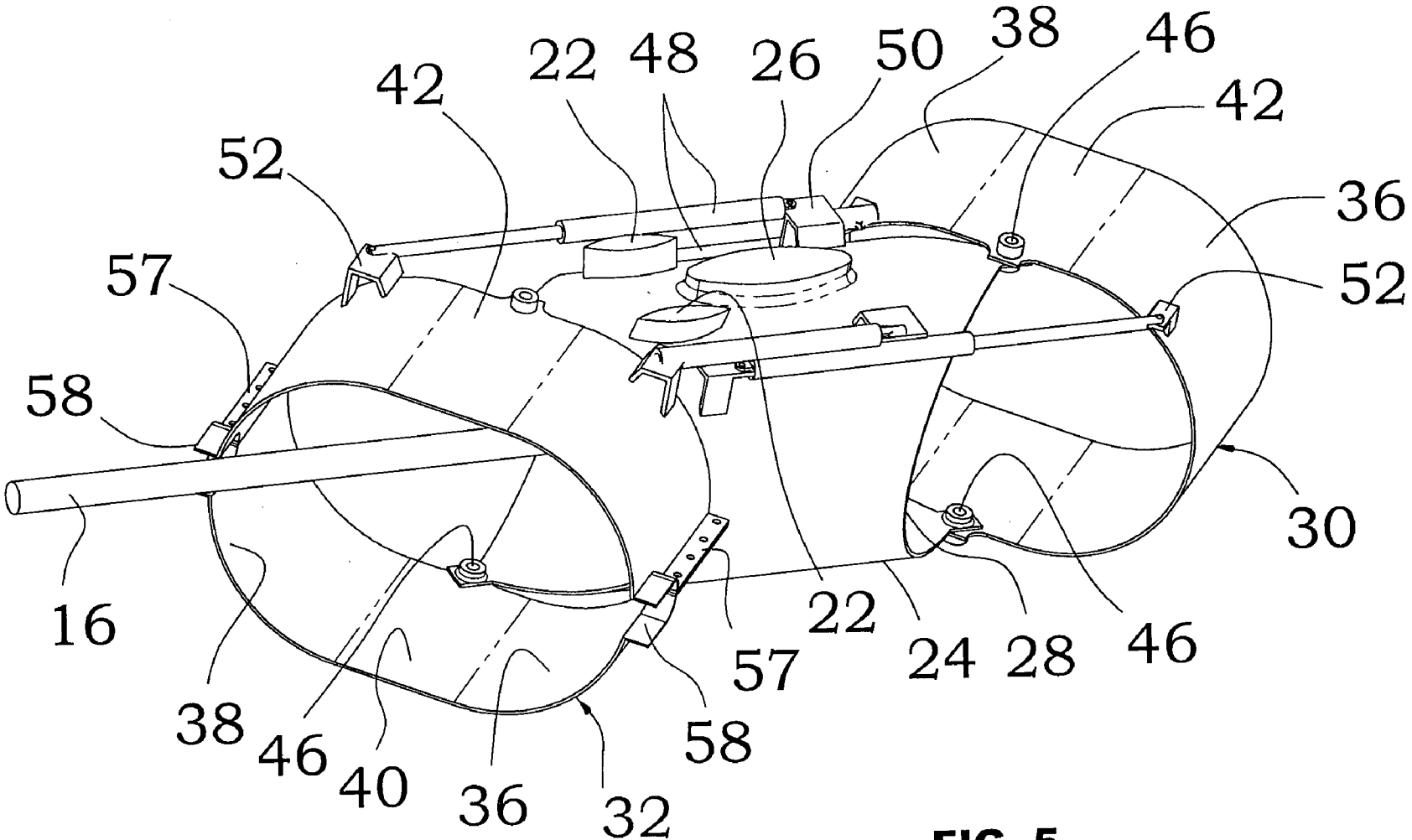
FIG. 5 is a view similar to FIG. 2, showing the rudders in the hard over position for a turn to starboard.

A forward steering tubular rudder 30 is mounted for pivoted movement about a vertical axis extending through the vertically aligned mounting tab 34 on the aft end of shroud tube 24 and a tubular backing rudder 32 is similarly mounted on the forward end of shroud tube 24. Rudders 30, 32 are generally oblong in vertical cross-section, with each including opposed laterally spaced semi-cylindrical side portions 36, 38 joined by generally flat top and bottom sections 40, 42, respectively. The inside diameter of the side portions 36, 38 are slightly greater than the outside diameter of shroud tube 24. The forward end of rudder 30 and the rear end of rudder 32, at the center of the flat top and bottom portions 40, 42, respectively are formed with axially extending mounting tabs 44 disposed in overlaying relation with tabs 34 on the shroud tube 24. Tabs 34, 44 may be reinforced if desired, and as best seen in FIG. 4*a*, suitable journal bearings pivot pin or shaft 46 joins the overlapping tabs 34, 44 so that tubular rudders 30, 32 are mounted for pivotal movement about vertical axis on the pointed end portions of the shroud tube 24.

In the embodiment shown in FIGS. 1–5, each of the rudder tubes 30, 32 are pivoted about their respective pivot axis, defined by the pins 46, by one or preferably two submersible fluid actuators 48 each having its cylinder end pivoted to a bracket 50 rigidly mounted as by welding on the external surface of shroud tube 24 and its rod end similarity pivotably mounted to the shroud 24 by bracket 52. Hydraulic fluid under pressure is supplied from the vessel 10 through a conduit (not shown) preferably extending downwardly into the mounting pad 26 and outwardly therefrom through flexible hoses (also not shown) having then ends connected to the fluid actuators. The actuator 48 may be single acting or double acting two actuators are employed to control each rudder tube, but must be double acting of only one actuator is used to control each rudder tube.

The backing rudder tube 32 consists of an upper half-section 54 having two steering brackets 52 mounted one on each lateral side thereof and a lower half section 56. The two sections 54, 56 are joined by removable bolts extending through opposed laterally extending flanges 57 on each side of each half section so that the rudder tube 32 can be removed without removal of the shroud tube 24 and the shaft bearing support structure. Also, two cut-outs 58 are formed, one on each side of the backing rudder tube 32 at its forward end to prevent contact with the shaft 16 when the rudder tubes are hard over to left or right. This permits use of a longer backing rudder tube and a greater rudder angle to provide greater lateral thrust and maneuverability.

By interconnecting the two rudder tubes for simultaneous movement in the same direction, steering control, or lateral thrust is increased whether the vessel 10 is being driven forward or backwards. For example, when the propeller 18 is turning in a direction for froward movement and the rudder assembly is in the position shown in FIG. 5, the slip stream, or rush, from the propeller will be diverted to starboard by the forward steering rudder 30, and the vessel will turn to starboard. At the same time, water flowing through the backing rudder 32 as a result of movement through the water and/or drawn by the propeller will also be redirected by the backing rudder and apply a thrust again tending to turn the vessel to starboard. Similarly, when the propeller 18 is driven in a direction to back the vessel so that the propeller rush is directed through the backing rudder 32, the forward steering rudder 30 will provide additional lateral thrust so that the two rudders always act in concert.

The oblong configuration of the two rudder tubes assures that the full rudder rush will be directed through a rudder tube regardless of the rudder angle, up to about 45°. Also the velocity of the rush through a tubular rudder of this oversized oblong configuration enables more water to be drawn through the rudder, by a venturi-like effect, which not only produces greater lateral, or steering thrust, but also enhances propulsion. The oblong rudder tube configuration and the side cut-backs on the shroud tube 24 enables the tubular rudders 30, 32 to be mounted on the shroud tube closer to the propeller and still be rotated about their pivot axes to a large steering angle without interference from the shroud tube. Also, the shroud tube 24, in addition to enhancing propulsion, produces a more coherent rush through the trailing tubular rudder, depending on the direction of movement, so that the rudder produces a greater steering thrust.

Figure 6:
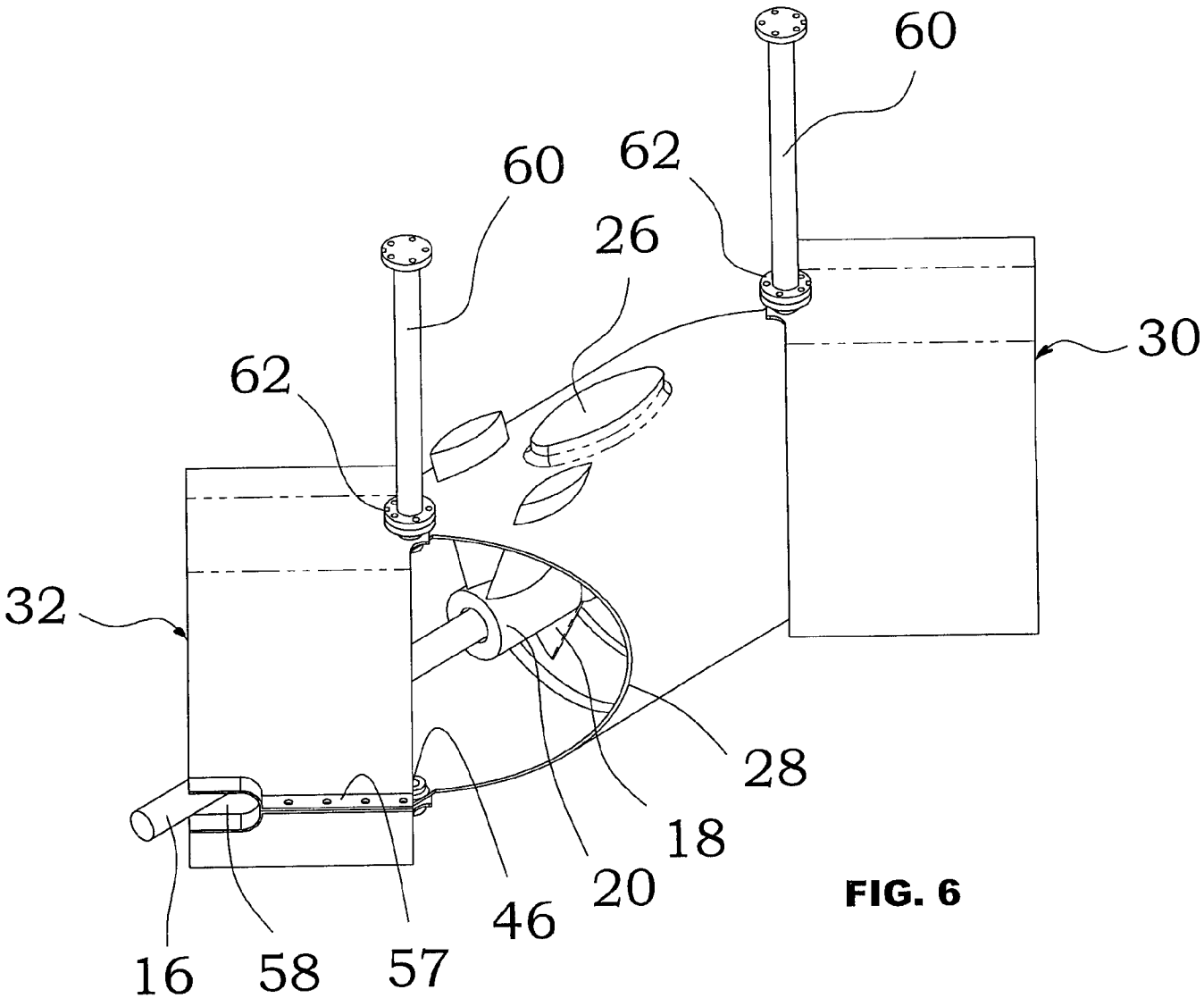
FIG. 6 is an isometric view of an alternate embodiment of the system.
Figure 7:
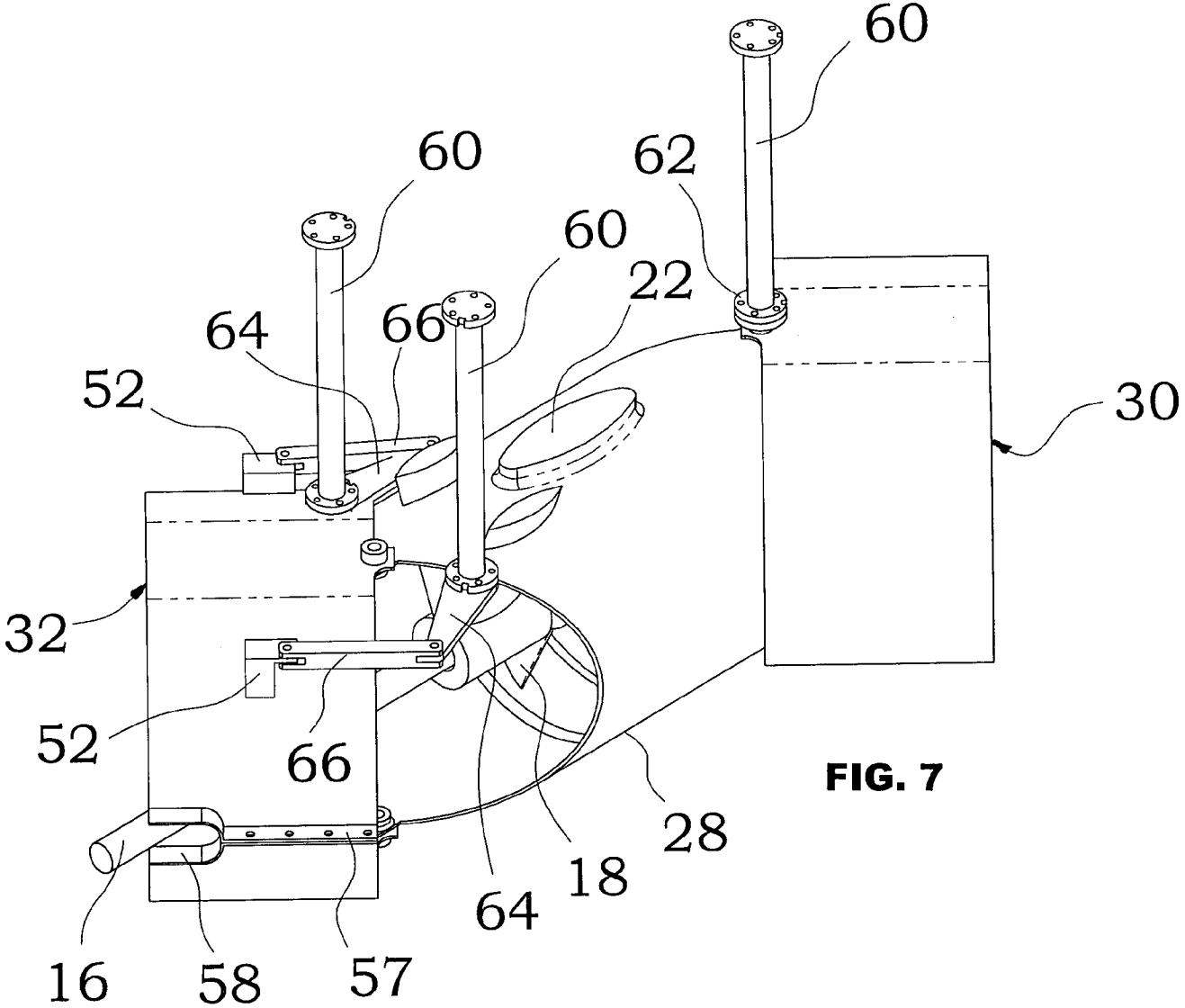
FIG. 7 is a view similar to FIG. 6 showing another embodiment.

Referring now to FIGS. 6 and 7, alternate embodiments of the steering and propulsion system of the invention will be described. In both these embodiments, the shroud tube 24 and the rudder tubes 30, 32, as well as their mounting on the ends of the shroud tube, are identical to that described above. In each of these alternative embodiments, however, the rudder tubes 30, 32 are driven in rotation by one or more rudder posts 60 extending downwardly through the bottom of the vessel and connected, as by a bolted flange 62 directly to a tubular rudder. The rudder post(s) 60 are driven by a suitable power mechanism (not shown) within the vessel in a manner similar to known drives for conventional blade rudders.

In the embodiment of FIG. 6, two driven rudder posts 60 are shown, one connected directly to each tubular rudder, whereas in FIG. 7, three driven rudder posts are employed. In the FIG. 7 embodiment, two laterally spaced driven rudder posts 60 each has a crank arm 64 mounted on its bottom end, with the crank arms each being connected through a pivoted linkage arm 66 to one of the steering brackets 52 rigidly mounted on the outer surface of the backing rudder 32. The two driven rudder posts 60 connected to the backing rudder 32 may be driven simultaneously, or one can be driven to turn the rudder in one direction and the other driven to turn the rudder in the opposite direction.

FIG. 7 also illustrates a third driven rudder post 60 connected to the forward steering rudder 30 by a flange 62 in the manner described above with reference to FIG. 6. It is understood, however, that other arrangements may be employed. For example, the third rudder post 60 may be eliminated by use of a pair of linkage arms employed to interconnect the rearwardly directed end of the backing rudder 32 to the forwardly directed end of the forward steering rudder 30 through the brackets 50, 52 in an articulated parallelogram fashion, for simultaneous movement. Such a linkage could also be employed in the structure shown in FIG. 6, in which case one of the driven rudder posts could be dispensed with.

It is believed apparent that mounting the tubular rudders to the shroud tube at both the top and bottom provides a very strong, rigid assembly, This is particularly important in vessels such as pleasure boats, or tugs and barge pushers employed, for example, an inland waterways, in any shallow water, or wherever obstructions such as floating debris is frequently encountered and where high maneuverability is important.

While preferred embodiments have been disclosed and described, it should be understood that the invention is not so limited and that it is intended to include all embodiments which would be apparent to one skilled in the art and which come within the spirit and scope of the invention.

I claim:

1. A steering and propulsion system for a propeller driven water craft comprising, a shaft driven propeller supported beneath a hull of the water craft, a tubular propeller shroud rigidly mounted on the water craft and surrounding the propeller, the propeller shroud extending forward and aft of the propeller, a tubular forward steering rudder having an open forward end pivotally mounted at the aft portion of the propeller shroud for movement about a vertical axis extending in the vertical plane of the propeller shaft, a tubular backing rudder having an open aft end pivotally mounted at the forward end of the propeller shroud for movement about a vertical axis extending in the vertical plane of the propeller shaft, and drive means operably connected to said forward steering rudder and said backing rudder for simultaneous movement about their respective pivot axes to steer the water craft.

2. The system defined in claim 1, wherein the forward steering rudder and the backing rudder are pivotally mounted on the adjacent end of the shroud tube.

3. The system defined in claim 2, wherein the tubular forward steering rudder and the backing tubular rudder are pivotally mounted one to both the top and bottom of each end portion of the shroud tube.

4. The system defined in claim 2, wherein the backing tubular rudder comprises a top segment and a bottom segment releasably connected to one another along longitude joints extending along laterally opposed sides.

5. The system defined in claim 3, wherein the backing tubular rudder comprises a top segment and a bottom segment releasably connected to one another along longitude joints extending along laterally opposed sides.

6. The system defined in claim 1, wherein said forwarding steering rudder and said backing rudder each have a cross sectional area greater than that of the shroud tube.

7. The system defined in claim 6, wherein said forward steering rudder and said backing rudder each have an oblong configuration in vertical cross section with generally flat top and bottom portions and generally semi-circular lateral side portions.

8. The system defined in claim 1, wherein said drive means comprises power means connected between said shroud tube and said forward steering rudder and between said shroud tube and said backing rudder.

9. The system defined in claim 8, wherein said power means comprises at least one submersible hydraulic actuator having one end operably connected to said shroud tube and the other end connected to one of said tubular rudders.

10. The system defined in claim 9, wherein said power means comprises two submersible hydraulic actuators connected one between said shroud tube and each of said forward steering rudder and said backing rudder.

11. The system defined in claim 1, wherein said drive means comprises at least one rudder post having one end connected to one of said tubular rudders and the other end extending into the water craft.

12. The system defined in claim 11 further comprising linkage means operably connecting said forward steering rudder and said backing rudder for simultaneous rotation by said at least one rudder post.

13. The system defined in claim 1, wherein said backing rudder comprises a recess in each laterally opposed sidewall at the open forward end thereof in position to receive the propeller shaft to permit the open end of the backing rudder to rotate past the propeller shaft in a hard over position of the rudder in either direction.

14. The system defined in claim 1, wherein said shroud tube terminates at its open forward and aft ends in opposed, axially extending top and bottom portions defined by cutting back the opposed sides along lines substantially defined by vertical planes extending at an oblique angle to the longitudinal axis of the shroud tube and intersecting at a vertical line contained in the vertical center plane of the shroud tube, the cut-back portions permitting rotation of the tubular rudders without interference from the shroud tube.

15. A steering and propulsion system for a propeller driven water craft, comprising a shaft driven propeller supported beneath a hull of the water craft a shroud tube surrounding the propeller, the shroud tube being rigidly mounted on the water craft and having open ends that extend forward and aft of the propeller a tubular forward steering rudder and a tubular backing rudder, mounting means supporting the forward steering rudder on the open aft end of the shroud tube at the top and bottom thereof for pivotal movement about a vertical axis, and supporting the backing rudder on the forward end of the shroud tube for pivotal movement about a vertical axis, and drive means operably connected to said forward steering rudder and to said backing rudder for rotating the rudders about their vertical pivot axes to steer the water craft.

16. The system defined in claim 15, wherein the backing tubular rudder comprises a top segment and a bottom segment releasably connected to one another along longitude joints extending along their laterally opposed sides.

17. The system defined in claim 15, wherein said forwarding steering rudder and said backing rudder each have a cross sectional area greater than that of the shroud tube.

18. The system defined in claim 17, wherein said forward steering rudder and said backing rudder each have an oblong configuration in vertical cross section, with generally flat top and bottom portions and generally semi-circular lateral side portions.

19. The system defined in claim 15, wherein said drive means comprises power means connected between said shroud tube and said forward steering rudder and between said shroud tube and said backing rudder.

20. The system defined in claim 19, wherein said power means comprises at least one submersible hydraulic actuator having one end operably connected to said shroud tube and the other end connected to one of said tubular rudders.

21. The system defined in claim 15, wherein said power means comprises at least two submersible hydraulic actuators, with at least one actuator connected between said shroud tube and each of said forward steering rudder and said backing rudder.

* * * * *